US008169400B2

(12) United States Patent
Shih

(10) Patent No.: US 8,169,400 B2
(45) Date of Patent: May 1, 2012

(54) DRIVE APPARATUS FOR BISTABLE DISPLAYER AND METHOD THEREOF

(75) Inventor: Chien-Chia Shih, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 874 days.

(21) Appl. No.: 11/467,115

(22) Filed: Aug. 24, 2006

(65) Prior Publication Data

US 2008/0018589 A1 Jan. 24, 2008

(30) Foreign Application Priority Data

Jul. 19, 2006 (TW) ..... 95126409 A

(51) Int. Cl.
*G09G 3/34* (2006.01)

(52) U.S. Cl. ..... 345/107

(58) Field of Classification Search ..... 345/87, 345/95, 107, 214, 84, 89, 76
See application file for complete search history.

(56) References Cited

U.S. PATENT DOCUMENTS 6,466,358 B2 * 10/2002 Tew ..... 359/292
6,816,138 B2 * 11/2004 Huang et al. ..... 345/87
7,012,600 B2 * 3/2006 Zehner et al. ..... 345/214
7,119,772 B2 * 10/2006 Amundson et al. ..... 345/87
2005/0162377 A1 * 7/2005 Zhou et al. ..... 345/107
2005/0280626 A1 * 12/2005 Amundson et al. ..... 345/107
2006/0152458 A1 * 7/2006 Angele et al. ..... 345/90
2006/0164405 A1 * 7/2006 Zhou ..... 345/204
2006/0170647 A1 * 8/2006 Zhou et al. ..... 345/107
2006/0170648 A1 * 8/2006 Zhou et al. ..... 345/107
2006/0170667 A1 * 8/2006 Zhou et al. ..... 345/208
2006/0244714 A1 * 11/2006 Zhou et al. ..... 345/107
2006/0262081 A1 * 11/2006 Zhou et al. ..... 345/107
2006/0262082 A1 * 11/2006 Johnson et al. ..... 345/107
2006/0262083 A1 * 11/2006 Zhou et al. ..... 345/107
2006/0274030 A1 * 12/2006 Johnson et al. ..... 345/107
2006/0279526 A1 * 12/2006 Zhou et al. ..... 345/107
2007/0013683 A1 * 1/2007 Zhou et al. ..... 345/204
2007/0035510 A1 * 2/2007 Zhou et al. ..... 345/107
2007/0052648 A1 * 3/2007 Zhou et al. ..... 345/94
2007/0070028 A1 * 3/2007 Zhou et al. ..... 345/107
2007/0075949 A1 * 4/2007 Lu et al. ..... 345/89
2007/0075963 A1 * 4/2007 Zhou et al. ..... 345/107
2007/0126673 A1 * 6/2007 Djordjev et al. ..... 345/84

* cited by examiner

*Primary Examiner* — Quan-Zhen Wang
*Assistant Examiner* — Tony Davis
(74) *Attorney, Agent, or Firm* — CKC & Partners Co., Ltd.

(57) ABSTRACT

A drive apparatus for a bistable displayer and a method thereof are provided for driving a bistable displayer with a plurality of pixels. The drive apparatus includes an initialization unit, a receiving unit and a display drive unit. The initialization unit is for generating at least one initial potential level to all pixels to perform initialization. The receiving unit is for receiving a plurality of gray levels. The display drive unit generates a waveform signal based on every gray level. The pulse width of the waveform signal relates to the value of the gray level. The waveform signal is then transmitted to a corresponding pixel to drive the pixel to be displayed.

13 Claims, 6 Drawing Sheets

DRIVE APPARATUS FOR BISTABLE DISPLAYER AND METHOD THEREOF

FIELD OF THE INVENTION

The present invention relates to a drive apparatus for bistable displayer and method thereof, and more particularly to a drive apparatus for bistable displayer and method thereof that perform an initialization while updating a screen.

BACKGROUND OF THE INVENTION

At present, the application of a thin panel display becomes increasingly popular and brings tremendous convenience to our life. Besides the thin film transistor liquid crystal display (TFT-LCD) technology, an electronic paper display is considered as a new-generation panel display technology Compared with the well-developed TFT-LCD technology, the electronic paper display adopts the principle of an "electrophoresis" by injecting electrically charged black or white chemical particles and solvents between two pieces of transparent glass or plastic substrates. In the portion of a thin film that carries negative charges, the positively charged black particles are attracted to flow and show a black color. The positively charged portion attracts the negatively charged fluorocarbon flow to show a white color (such phenomenon is called "electrophoresis" phenomenon). Therefore, different potential levels supplied to different positions of pixels will display different colors to constitute an image.

The foregoing display principle has a bistable feature, because the solvents and charged particles approximately have the same weight. Even if the electric field disappears, the charged particles still can be maintained at the fixed positions for a specific long period of time until a next electric field brings up the motions of electrically charged particles to produce another image. Therefore, after a display is updated for each time, it does not need a continuous charging so that the power consumption will be very low. If it is necessary to form a gray level display, an electric field can be used to control the charged particles to flow to a certain level to show a gray. Besides, the charged particles with different colors such as a red color, a green color or a blue color can be used to achieve the color display effect. A displayer adopting the foregoing principle of electrophoresis is called an electrophoretic display (EPD). Compared with TFT-LCD, EPD has the advantages of a high contrast, and a wide viewing angle from 90 degrees to −90 degrees without requiring components such as a backlight panel, a color filter and a polarizer, and thus greatly reducing both weight and cost of the display device.

However, most traditional drive apparatuses for bistable displayers use a frame buffer structure for recording the pixel data of a previous image, and then the drive apparatus compares the pixel data of a desired displaying image with the pixel data in the frame buffer and calculates the difference of gray levels of every pixel at the previous image and the desired displaying image, and then produces a drive signal based on the difference to drive a corresponding pixel to display the desired displaying image. Although a bistable displayer using this kind of drive apparatus has a shorter response time, a more complicated circuit design of the drive apparatus and requires additional memories, yet the traditional drive apparatus is not applicable for applications that do not require a fast response time such as the applications in electronic tags.

In view of the shortcomings of the prior art, the inventor of the present invention based on years of experience in the related industry to develop a drive apparatus for a bistable displayer and method thereof to overcome the shortcomings of the prior art.

SUMMARY OF THE INVENTION

Therefore, it is a primary objective of the present invention is to provide a drive apparatus for a bistable displayer and method thereof, so that the same pixels can have the same drive structure for their display.

A drive apparatus for a bistable displayer in accordance with the invention is used to drive a bistable displayer, and the bistable displayer has a plurality of pixels, and the drive apparatus includes an initialization unit, a receiving unit and a display drive unit. The initialization unit is provided for producing at least one initial potential level and transmitting the initial potential level to all pixels. The receiving unit is provided for receiving at least one gray level, and the gray levels are used for displaying the pixels. The display drive unit produces a waveform signal based on every gray level, and the waveform signal has a pulse width related to the value of the gray level, and the display drive unit transmits the waveform signal to a corresponding pixel to drive the pixel to be displayed.

The invention also provides a drive method for driving a bistable displayer having a plurality of pixels, and the method comprises the steps of: providing at least one initial potential level signal to all pixels; receiving a plurality of gray levels, and every gray level corresponds to a pixel; producing a waveform signal based on every gray level, and the waveform signal has a pulse width related to the value of the gray level; and transmitting the waveform signal to a corresponding pixel to drive the pixel to be displayed.

An advantage of the present invention resides on that the invention can improve the performance of the bistable displayer without requiring a complicated drive structure.

Another advantage of the present invention is that the invention can use the same waveform signal if the target display status is the same, regardless of the previous display status.

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

For simplicity, the same symbol or label is used for the same element for the description of a preferred embodiment of the drive apparatus for bistable displayer and method thereof in accordance with the present invention.

Figure 1:
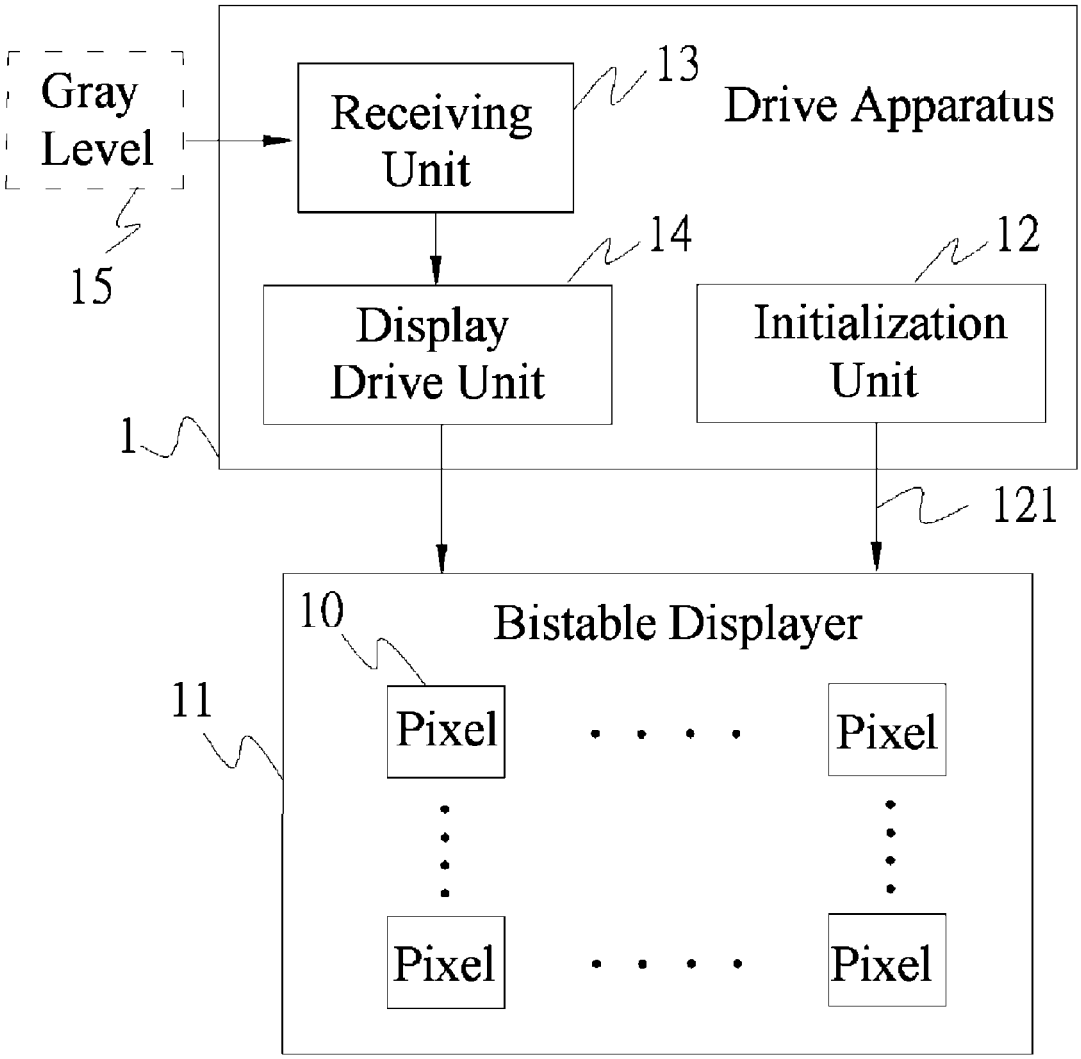
FIG. 1 is a block diagram of a drive apparatus for a bistable displayer of the present invention.

Referring to FIG. 1 for a block diagram of a drive apparatus for a bistable displayer in accordance with the present invention, the drive apparatus 1 is used for driving a bistable displayer 11 having a plurality of pixels 10. The drive apparatus 1 comprises an initialization unit 12, a receiving unit 13 and a display drive unit 14. The initialization unit 12 produces at least one initial potential level 121 and transmits the initial potential level 121 to all pixels 10 to drive all pixels 10 to display at least one initial gray level. The initial gray level could be a black color, a white color, or any predetermined gray level. The initialization unit 12 can transmit two successive different initial potential levels to all pixels 10, if needed. The receiving unit 13 receives at least one gray level 15 of the desired displaying image, and every gray level 15 is displayed at each pixel 10.

According to the display principle of a bistable displayer, the longer the time of applying a potential level, the brighter (or the darker) is the display color of the pixel 10. Therefore, the display drive unit 14 produces a waveform signal 16 based on the gray level 15, and the pulse width of the waveform signal is related to the value of the gray level, and the display drive unit 14 transmits the waveform signal 16 to a corresponding pixel 10 to drive the pixel 10 to be displayed, and an image is formed by transmitting the waveform signal 16 to all pixels 10. The image can be maintained for a specific long time until the screen is updated next time, then initialization unit 12 produces at least one initial potential level 121 and transmits the initial potential to all pixels 10 to drive all pixels 10 to display an initial gray level, and clears the previous screen, and then displays a new image based on the foregoing contents.

Figure 2A:
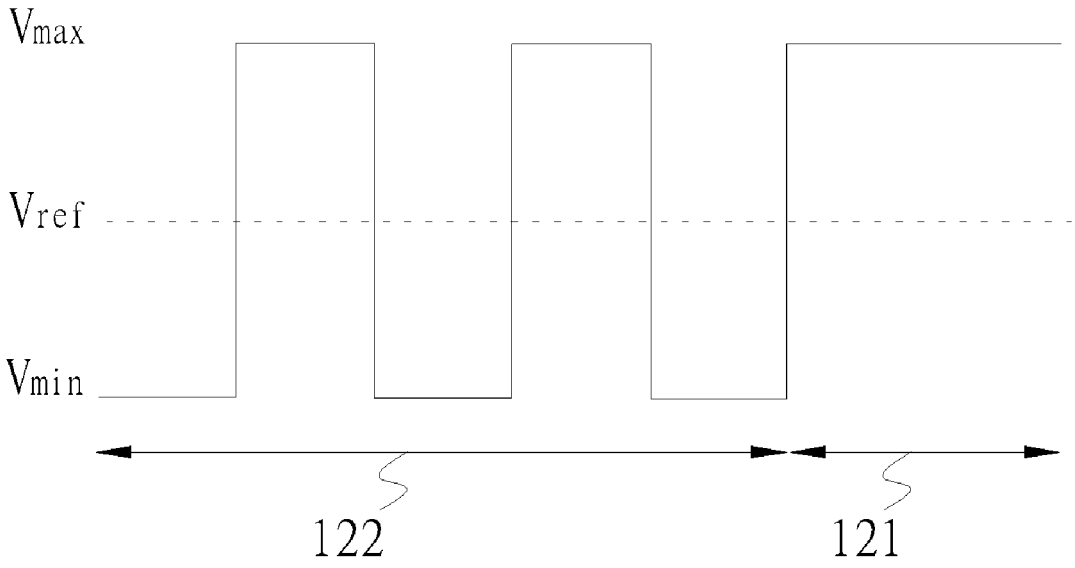
FIG. 2A is a schematic view of an example of an initialization signal of the present invention.
Figure 2B:
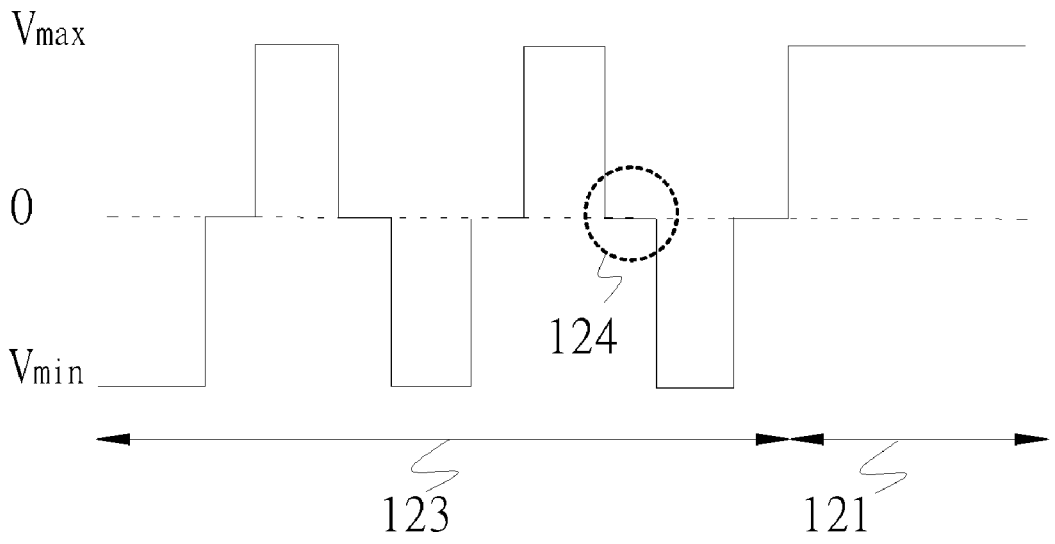
FIG. 2B is a schematic view of another example of an initialization signal of the present invention.

Before the initialization unit 12 provides the initial potential level 121 to the pixel 10, a pulse signal 122 can be produced and provided to the pixel 10 if needed as shown in FIG. 2A, and the initialization unit 12 provides a pulse signal 122 and an initial potential level 121 to all pixels 10 for the initialization. By switching different voltages of the pulse signal 122, the charged particles in the bistable displayer will be vibrated to get a better effect for displaying the initial gray level at the next step. Further, the waveform of the pulse signal 122 may vary according to actual needs as shown in FIG. 2B. If Vref is a zero potential, then the waveform of the pulse signal 123 switched between Vmax and Vmin includes at least one zero potential level component 124. In addition to driving the electrically charged particles to vibrate, the pulse signal also can eliminate the net DC value remained in the pixel. In the pulse signals 122, 123, a preferable difference between Vmax and Vref is equal or close to the difference between Vmin and Vref as shown in the following equation:

$$V\text{max}-V\text{ref}>=V\text{ref}-V\text{min}$$

The foregoing bistable displayer is an electrophoretic display (EPD) or a bistable liquid crystal display screen. The pixel 10 preferably includes at least one thin film transistor (TFT).

Figure 3:
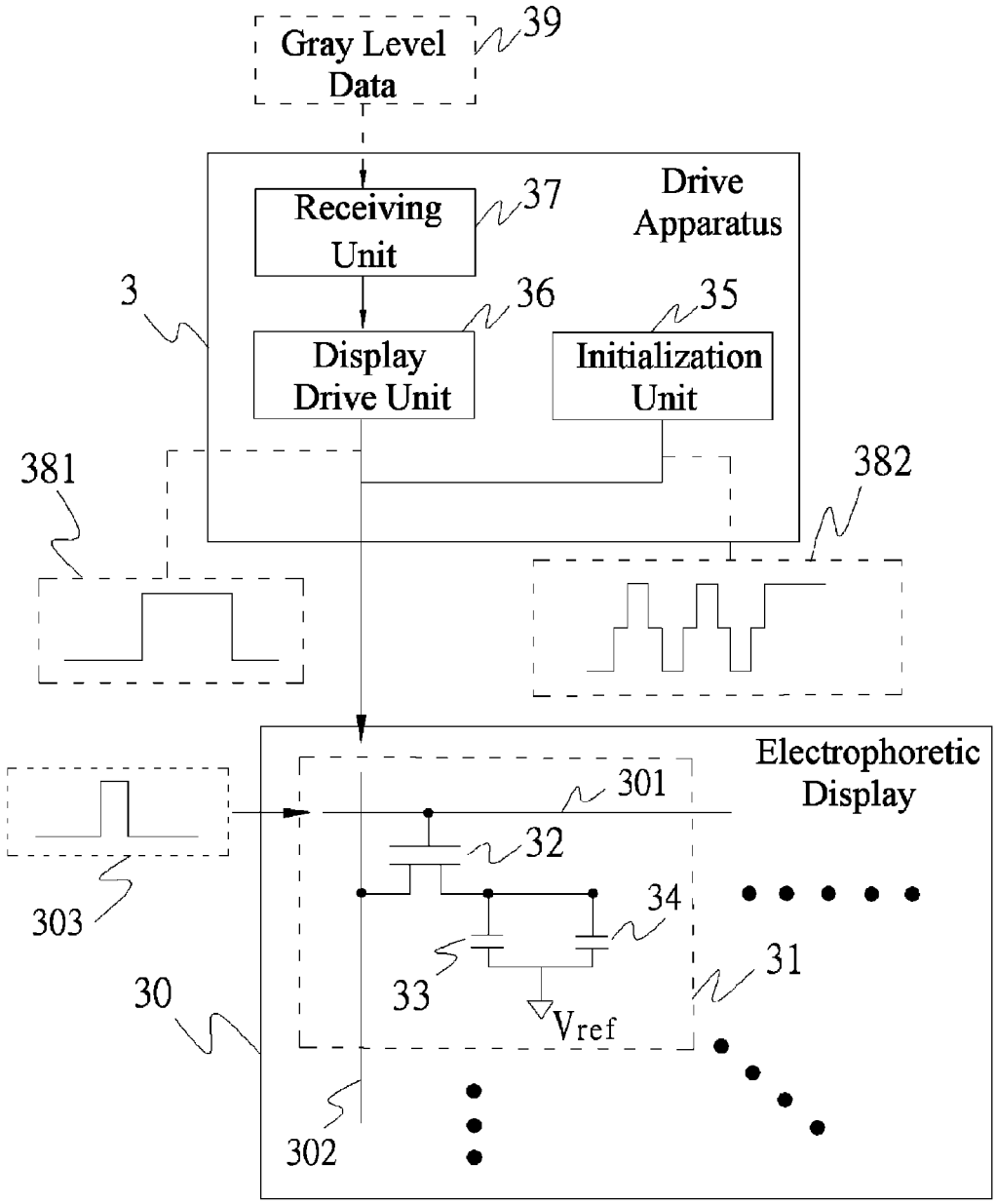
FIG. 3 is a block diagram of a drive apparatus for a bistable displayer of the present invention.

Referring to FIG. 3 for a block diagram of a drive apparatus for a bistable displayer of the present invention, the drive apparatus 3 is used for driving an electrophoretic display 30. The electrophoretic display 30 includes a plurality of pixel units 31 arranged in a matrix form. Each pixel unit 31 has at least one thin film transistor 32, a storage capacitor 33 and an electrophoretic display unit 34. A gate of the thin film transistor 32 is electrically coupled to a gate line 301, and a source of the thin film transistor 32 is electrically coupled to a source line 302. An end of the storage capacitor 33 and an end of the electrophoretic display unit 34 are electrically coupled to a drain of the thin film transistor 32, and another end of the storage capacitor 33 and another end of the electrophoretic display unit 34 are electrically coupled to a voltage source Vref. The gate line receives a pulse signal 303 for controlling an ON state or an OFF state of the thin film transistors in the same row. In the ON state, the electrophoretic display unit 34 can receive an initialization signal 382 transmitted from the source line 302 for the initialization and a waveform signal 381 for the display.

The drive apparatus 3 comprises a receiving unit 37, a display drive unit 36 and an initialization unit 35. If a user wants to update a screen of the electrophoretic display, the initialization unit will produce an initialization signal 382 having a pulse component and an initial voltage component (as shown in FIG. 2B) and transmitting the initialization signal 382 to the pixel unit 31 through the source line, and the pulse component can drive the electrically charged particles of the electrophoretic display unit to vibrate, and the initial potential level component can drive all electrophoretic display units to display an initial gray level.

Then, the receiving unit 37 receives a gray level data 39 of a user's desired displaying image and converts each gray level data 39 into a waveform signal 381 through the display drive unit 36, and the pulse width of the waveform signal 381 is directly or inversely proportional to the value of the gray level. If the pulse width of the waveform signal 381 is directly proportional to the value of the gray level, it means that the higher the value of the gray level, the longer is the pulse width of the waveform signal 381. For example, the pulse width of the waveform signal of the value 250 of the gray level is greater than the pulse width of the waveform signal of the value 150 of the gray level. Regardless of the previous display gray level of this pixel, the display drive unit 36 produces the waveform signals with the same pulse width based on the same value of the gray level.

Figure 4:
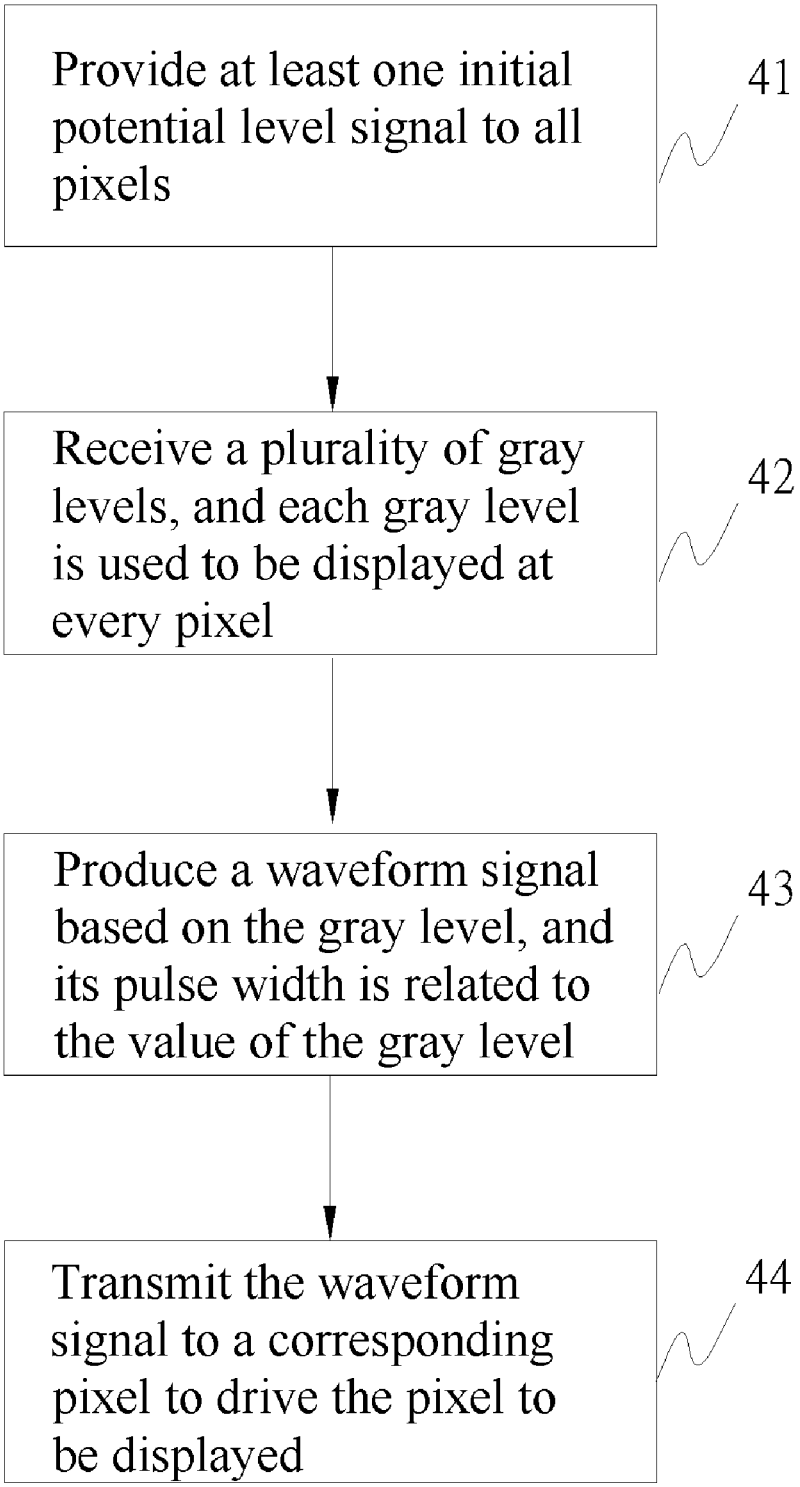
FIG. 4 is a flow chart of a method for driving a bistable displayer of the present invention.

Referring to FIG. 4 for a flow chart of a drive method for driving a bistable displayer, the method is provided for driving a bistable displayer having a plurality of pixels, and the method comprises the steps of:

Step 41: providing at least one initial potential level signal to all pixels;

Step 42: receiving a plurality of gray levels, and each gray level is displayed at every pixel;

Step 43: producing a waveform signal based on the gray level, and its pulse width is related to the value of the gray level; and Step 44: transmitting the waveform signal to a corresponding pixel to drive the pixel to be displayed.

Figure 5:
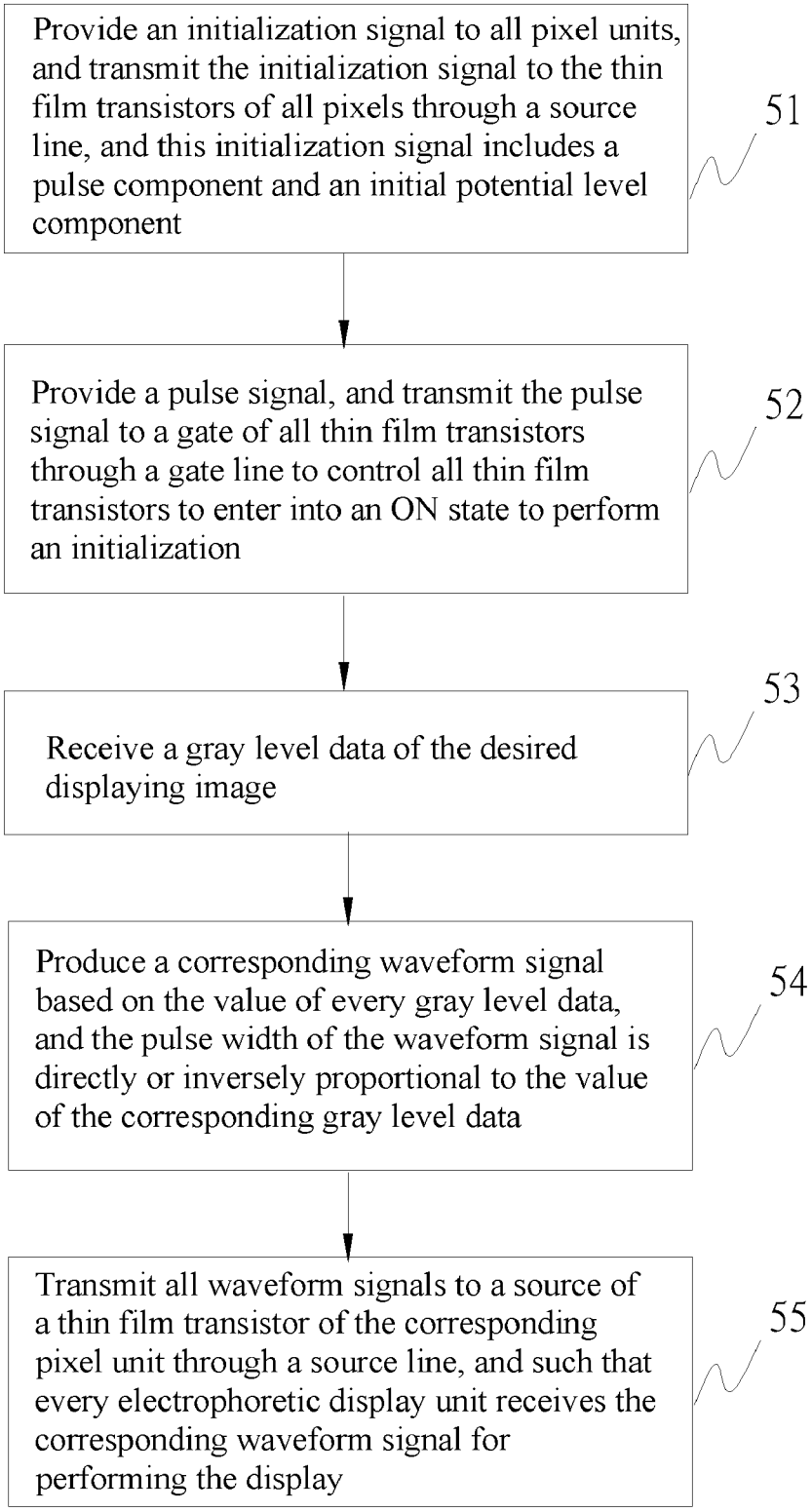
FIG. 5 is a flow chart of a method of driving a bistable displayer in accordance with a preferred embodiment of the present invention.

Referring to FIG. 5 for a flow chart of a method of driving bistable displayer in accordance with a preferred embodiment of the present invention, the method is provided for driving a stable electrophoretic display having a plurality of pixels as shown in FIG. 3, and the method comprises the steps of:

Step 51: using an initialization unit 35 to produce an initialization signal 382, and transmitting the initialization signal 382 to a source of a thin film transistor 32 of all pixel units 31 through a source line 302, and this initialization signal 382 includes a pulse component and an initial potential level component;

Step 52: providing a pulse signal 303, and transmitting the pulse signal 303 to a gate of all thin film transistors 32 through a gate line 301 to control all thin film transistors 32 to enter into an ON state to perform an initialization;

Step 53: using a receiving unit 37 to receive a gray level data 39 of the desired displaying image;

Step 54: producing a corresponding waveform signal 381 based on the value of every gray level data 39, and the pulse width of the waveform signal 381 is directly or inversely proportional to the value of the corresponding gray level data 39; and Step 55: transmitting all waveform signals 381 to a source of a thin film transistor 32 of the corresponding pixel unit 31 through a source line 302, and controlling all thin film transistors 32 to enter into an ON state, such that every electrophoretic display unit 34 receives the corresponding waveform signal 381 for performing the display.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A drive apparatus for driving a bistable displayer, and said bistable displayer having a plurality of pixels and a plurality of source lines respectively connected to the pixels, and said drive apparatus comprising:

an initialization unit connected to the source lines for producing at least one initial potential level signal, which operates independently of a previous displaying image and a desired displaying image, and transmitting said initial potential level signal to all of said pixels through the source lines, said initialization unit producing a pulse signal and sending said pulse signal to all of said pixels through the source lines prior to said initial potential level signal, and said pulse signal comprising a plurality of pulses with a maximum voltage level of Vmax and a minimum voltage level of Vmin, and a reference potential component at a reference voltage level of Vref existing in each transitions between Vmax and Vmin of the plurality of pulses;

a receiving unit, arranged for receiving at least one gray level signal; and a display drive unit, arranged for producing a waveform signal based on said gray level signal, and said waveform signal has a pulse width related to the value of said gray level signal, and said display drive unit transmits said waveform signal to a corresponding pixel to drive said pixel to be displayed;

wherein, the reference potential component that is transmitted through the source lines is kept at the reference voltage level of Vref for a predetermined period of time that is long enough to eliminate the net DC value remained in said pixels.

2. The drive apparatus of claim 1, further satisfying: Vmax−Vref>Vref−Vmin.

3. The drive apparatus of claim 2, further satisfying Vref=0.

4. The drive apparatus of claim 3, wherein said bistable displayer is an electrophoretic display (EPD) or a bistable liquid crystal display screen.

5. The drive apparatus of claim 3, wherein said each pixel includes at least one thin film transistor (TFT).

6. The drive apparatus of claim 3, wherein said waveform signal has a pulse width directly or inversely proportional to the value of said gray level signal.

7. A drive method for driving a bistable displayer, and said bistable displayer having a plurality of pixels and a plurality of source lines respectively connected to the pixels, and said method comprising the steps of:

producing and sending a pulse signal to all of said pixels through the source lines, said pulse signal comprising a plurality of pulses with a maximum voltage level of Vmax and a minimum voltage level of Vmin, and a reference potential component at a reference voltage level of Vref existing in each transitions between Vmax and Vmin of the plurality of pulses;

providing at least one initial potential level signal which is applied directly after said pulse signal and operates independently of a previous displaying image and a desired displaying image to all of said pixels through the source lines;

receiving at least one gray level signal;

producing a waveform signal based on every gray level signal, and said waveform signal has a pulse width related to the value of said gray level signal; and transmitting said waveform signal to a corresponding pixel to drive said pixel to be displayed;

wherein, the reference potential component that is transmitted through the source lines is kept at the reference voltage level of Vref for a predetermined period of time that is long enough to eliminate the net DC value remained in said pixels.

8. The drive method of claim 7, further satisfying: Vmax−Vref>Vref−Vmin.

9. The drive method of claim 8, further satisfying Vref=0.

10. The drive method of claim 9, wherein said bistable displayer is an electrophoretic display (ESD) or a bistable liquid crystal display screen.

11. The drive method of claim 9, wherein said each pixel includes at least one thin film transistor.

12. The drive method of claim 9, wherein said waveform signal has a pulse width directly or inversely proportional to the value of said gray level signal.

13. A drive apparatus for driving a bistable displayer, and said bistable displayer having a plurality of pixels and a plurality of source lines respectively connected to the pixels, and said drive apparatus comprising:

an initialization unit connected to the source lines for producing at least one initial potential level signal, which operates independently of a previous displaying image and a desired displaying image, and transmitting said initial potential level signal to all of said pixels through the source lines, said initialization unit producing a pulse signal and sending said pulse signal to all of said pixels through the source lines prior to said initial potential level signal, wherein said pulse signal transits from a minimum voltage level of Vmin to a zero potential level, then said pulse signal transits from the zero potential level to a maximum voltage level of Vmax, then said pulse signal transits from Vmax to the zero potential level, and then said pulse signal transits from the zero potential level to Vmax, wherein the pulse signal that is transmitted through the source lines is kept at the zero potential level for a predetermined period of time that is long enough to eliminate the net DC value remained in said pixels;

a receiving unit, arranged for receiving at least one gray level signal; and a display drive unit, arranged for producing a waveform signal based on said gray level signal, and said waveform signal has a pulse width related to the value of said gray level signal, and said display drive unit transmits said waveform signal to a corresponding pixel to drive said pixel to be displayed.

* * * * *